US007773069B2

(12) United States Patent
Miyasaka et al.

(10) Patent No.: US 7,773,069 B2
(45) Date of Patent: Aug. 10, 2010

(54) METHOD OF DRIVING AN ELECTROPHORETIC DISPLAY

(75) Inventors: Mitsutoshi Miyasaka, Suwa (JP); Atsushi Miyazaki, Fujimi (JP); Hideyuki Kawai, Fujimi (JP)

(73) Assignee: Seiko Epson Corporation (JP)

( * ) Notice: Subject to any disclaimer, the term of this patent is extended or adjusted under 35 U.S.C. 154(b) by 932 days.

(21) Appl. No.: 11/330,304

(22) Filed: Jan. 11, 2006

(65) Prior Publication Data

US 2006/0192751 A1 Aug. 31, 2006

(30) Foreign Application Priority Data

Feb. 28, 2005 (JP) ..... 2005-052622
Apr. 15, 2005 (JP) ..... 2005-117872

(51) Int. Cl.
*G09G 3/34* (2006.01)

(52) U.S. Cl. ..... 345/107; 345/105

(58) Field of Classification Search ..... 345/105, 345/690, 694, 698, 208, 214, 36, 38, 44, 345/49, 50, 55, 76, 87, 107
See application file for complete search history.

(56) References Cited

U.S. PATENT DOCUMENTS 6,278,429 B1 * 8/2001 Ruth et al. ..... 345/94
6,791,740 B2 * 9/2004 Katase ..... 359/281
6,819,317 B1 11/2004 Komura et al.
6,940,500 B2 * 9/2005 Washio et al. ..... 345/204
2003/0137521 A1 * 7/2003 Zehner et al. ..... 345/589
2003/0197915 A1 * 10/2003 Hou et al. ..... 359/296
2003/0206331 A1 * 11/2003 Chung et al. ..... 359/296
2004/0227720 A1 11/2004 Shikina et al.
2005/0024353 A1 * 2/2005 Amundson et al. ..... 345/204

FOREIGN PATENT DOCUMENTS

| | | |
|---|---|---|
| CN | 1420482 | 5/2003 |
| JP | 2001-125068 | 5/2001 |
| JP | 2002-014654 | 1/2002 |
| JP | 2002-116733 | 4/2002 |
| JP | 2004-102055 | 4/2004 |
| JP | 2005-148711 | 6/2005 |
| WO | WO2004-34366 | 4/2004 |
| WO | WO2004-100121 | 11/2004 |

* cited by examiner

*Primary Examiner*—Amr Awad
*Assistant Examiner*—John Morris
(74) *Attorney, Agent, or Firm*—Harness, Dickey & Pierce, P.L.C.

(57) ABSTRACT

An electrophoretic display device includes M×N numbers (M, and N are integers more than two) of pixels. The M×N numbers of pixels include M numbers of pixel groups having N numbers of pixels. Further, an image on the electrophoretic display device is displayed by making some of the M×N numbers of pixels switched at least from a bright display to a dark display, and vice versa. A period for displaying one piece of an image on the electrophoretic display is defined as period for forming an image and a period for introducing an image signal to each of the M×N numbers of pixels with sequentially selecting each of the pixels is defined as a frame period. Then, the time for forming an image includes a plurality of frame periods (a numbers of L: L is integers more than two).

19 Claims, 4 Drawing Sheets

METHOD OF DRIVING AN ELECTROPHORETIC DISPLAY

THE BACKGROUND OF THE INVENTION

1. Technical Field

The present invention relates to a method of driving an electrophoretic display provided with dispersion system including electrophoretic particles.

2. Relate Art

Dispersing micro particles having positive or negative electric charges into a liquid and applying electrical field to them from outside makes these micro particles migrate by a coulomb power. This phenomena is called as electrophoretic migration and a display using the electrophoretic migration is well known as an electrophoretic display (EPD.) Such electrophoretic display is be better suited for an electronic paper. In particular, an active marix type display in which pixel electrodes are arranged in a matrix is under development. JA2002-116733 is an example of a related art regarding such development.

An active matrix type electrophoretic display (AMEPD) is provided with a plurality of scanning lines and signal lines, which are orthogonally arranged each other. An electrophoretic element is provided at the cross section between a scanning line and a signal line, forming a pixel. Each of pixels includes a switching transistor and a pixel electrode. One of pixels arranged in a matrix is sequentially selected by a switching transistor and a predetermined image is introduced into each of pixel, forming a piece of an image. An example of a driving method for image displaying is explained referring to FIG. 7. An AMEPD comprises an active substrate, an opposing substrate and a dispersion system between these substrates. The active substrate includes scanning lines, signal lines and pixels (pixel electrodes and switching transistors) formed thereon. The opposite substrate has a common electrode. The dispersion system includes an electrophoretic element (an electrophoretic material.) An voltage Vcom which is common for all pixel electrodes is applied to the common electrode and a predetermined image signal is applied to each of pixel electrodes. A period for forming a piece of an image in a AMEPD is defined as a period for forming an image in the invention. In the conventional, the period for forming an image includes a reset period and a period for introducing an image signal. The reset period is a period for erasing a previous image. On the other hand, the period for introducing an image signal corresponds to a period for forming a new image in a AMEPD. In a AMEPD comprising M numbers of scanning lines and N numbers of image signal lines which are arranged in a matrix, one of the scanning lines is sequentially selected and, then an image signal is applied to the N numbers of pixels connected to the selected scanning line during this selected period. A period when one scanning line is selected, is called as a horizontal scanning period and a period when all scanning lines are selected (M times of horizontal scanning periods), is generally called as a frame period. In the conventional technology, the period for introducing an image signal included the frame period and M times of the horizontal scanning period (a vertical scanning period) and the reset period, forming a piece of an image in a MEPD.

In an electrophoretic display, micro particles physically migrate in a dispersion medium, changing spatial distribution of micro particles between a pair of substrates, thus changing displaying. A period when micro particles migrate in a dispersion medium at the time of applying voltage corresponds the response time of an electrophoretic display. This time is several milliseconds at the shortest, generally several hundred milliseconds. Namely, time for changing an image is about several hundred milliseconds. Hence, a horizontal scanning period was from several tens milliseconds to several hundred milliseconds in the past. The conventional AMEPD having small numbers of pixels and low resolution used this simple driving method.

However, if a new AMEPD having increased numbers of pixels and high resolution is manufactured, the numbers of scanning lines (M) are increased several hundred numbers and a period for forming an image (1 frame period) becomes several seconds or several tens seconds. Then it becomes a problem that the state of changing an image corresponding to selecting a scanning line is recognized by a viewer and it is uneasy to see changing display.

SUMMARY

The advantage of the invention is to provide a method of driving an AMEPD in which a viewer does not feel uncomfortable at the time of changing an image, even if an electrophoretic material having longer response time is used in a high resolution EPD.

The present invention relates to a method of driving an electrophoretic display device which encapsulates an electrophoretic material between a pair of an substrate. According one aspect of the invention, the electrophoretic display device includes M×N numbers (M, and N are integers more than two) of pixels. The M×N numbers of pixels include M numbers of pixel groups having N numbers of pixels. Further, an image on the electrophoretic display device is displayed by making some of the M×N numbers of pixels switched at least from a bright display to a dark display, and vice versa. A period for displaying one piece of an image on the electrophoretic display is defined as period for forming an image and a period for introducing an image signal to each of the M×N numbers of pixels with sequentially selecting each of the pixels is defined as a frame period. Then, the time for forming an image includes a plurality of frame periods (a numbers of L: L is integers more than two.)

According other aspect of the invention, the electrophoretic display device includes M×N numbers (M, and N are integers more than two) of pixels. The M×N numbers of pixels include M numbers of scanning pixel groups having N numbers of pixels. Further, an image on the electrophoretic display device is displayed by making some of the M×N numbers of pixels switched at least from a bright display to a dark display, and vice versa. A period for displaying one piece of an image on the electrophoretic display is defined as period for forming an image and a period for introducing an image signal to each of the M×N numbers of pixels with sequentially selecting each of the pixels is defined as a frame period. Then, the time for forming an image includes a plurality of frame periods (a numbers of L: L is integers more than two.)

Further, in the invention, total period of the plurality of frame periods (L numbers) may be a period which is L times of one frame period. In the invention, the period for forming an image may include a reset period which introduces the same image signal to all the M×N numbers of pixels. In the invention, when the period for forming an image includes the reset period, this period may further include a period, which is L times of one frame period. An image introduced during the reset time may be a signal for displaying brightness or darkness. An favorite image without including residual image is obtained if the reset time is longer than the response time of an electrophoretic material. On the other hand, the frame period is favorably shorter than he response time of an electrophoretic material. An image displayed by an EPD is good for human eyes without being tired if a frame period is shorter than 250 milliseconds.

In the present invention, when a period for selecting one of pixels groups is defined as a scanning period, a frame period may be M numbers of scanning periods. In the present invention, an EPD may have an arrangement of M×N matrix and a period for selecting one of M numbers of scanning pixels groups may be defined as a horizontal scanning period. Then, a frame period may be M numbers of a horizontal scanning periods.

In the invention, an image signal applying each of pixels during the period for forming an image may be applied to the same pixel during all frame periods.

In the invention, the period for forming an image may be longer than the response time of an electrophoretic material. Further, the period for forming an image may include five or more numbers of frame periods. Further, the period for forming an image may be less than two seconds.

BRIEF DESCRIPTION OF THE DRAWINGS

The invention will be described with reference to the accompanying drawings, wherein like numbers refer to like elements, and wherein.

DESCRIPTION OF EMBODIMENTS

The present invention relates to a method of driving an electrophoretic display (EPD), which encapsulates an electrophoretic material between a pair of substrates. In an EPD, a plurality of pixel electrodes are formed on one of a pair of substrates and a common electrode is formed on another of them. A substrate in which pixel electrodes are formed as segment electrodes is called as a segment substrate, being capable of displaying segments with an EPD. If a plurality of pixel electrodes are arranged in a matrix on one substrate, such substrate is called as a matrix substrate, being capable of displaying a matrix. The present invention can be applied to both segment display and matrix display. A dispersion system (an electrophoretic material) including electrophoretic particles is encapsulated between a segment or matrix substrate and an opposite substrate. Voltage Vcom, which is common for all pixel electrodes, is applied to the common electrode and a predetermined image signal is applied to each of pixel electrodes. In the electrophoretic display of the invention, M×N numbers (M and N are integers more than two) of pixels are formed on a segment or matrix substrate. These M×N numbers of pixels include M numbers of pixel groups including N numbers of pixels. For example, in case when the number 8 is displayed by a segment substrate, seven segments (N=7) is provided in a single digit and M numbers of digits are included in a pixel. A comma or a monetary unit such as yen may be included in a pixel. Further, displaying an image on the electrophoretic display device by making some of the M×N numbers of pixels switched at least from a bright (white) display to a dark (black) display, and vice versa. It is also possible to display a gray scale instead of bright and dark displays. In this invention, a period for displaying a piece of an image on the electrophoretic display device is defined as a period for forming an image and a period for introducing an image signal to each of the M×N numbers of pixels with sequentially selecting each of the pixels is defined as a frame period. One pixel group includes N numbers of pixels and one pixel group is selected from M numbers of pixel groups if they are M pieces. An image signal is sequentially or concurrently introduced to N numbers of pixels during such selected period. A period when all M numbers of pixel groups are selected, is a frame period. In the EPD of the invention, a period for forming an image includes a plurality of frame periods (L numbers are integers more than 2.)

Figure 1:
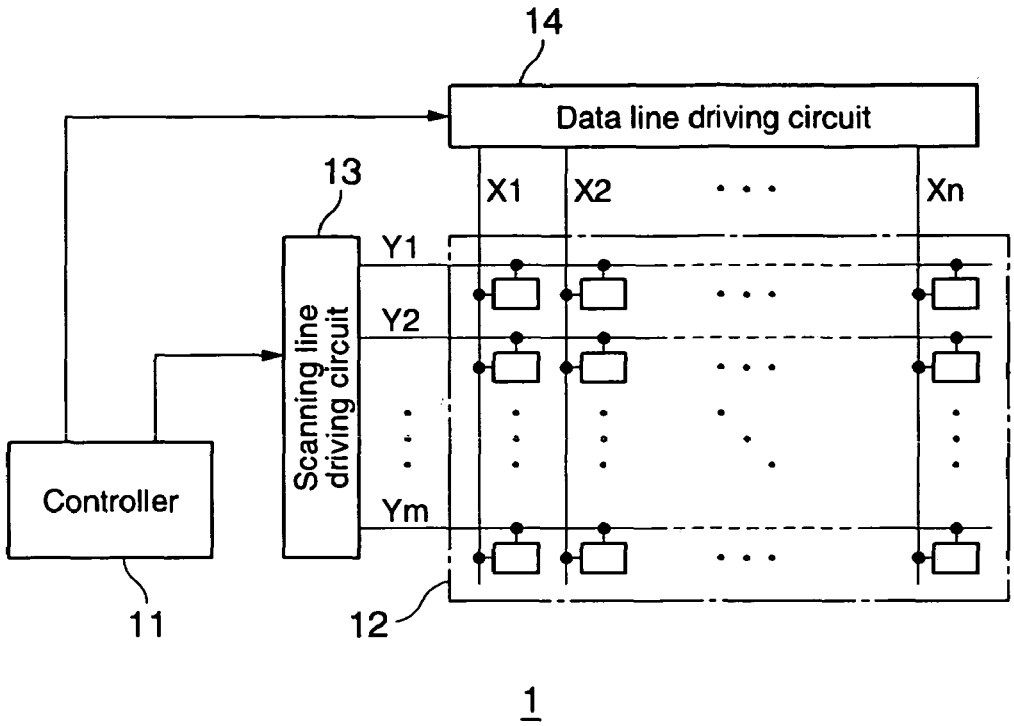
FIG. 1 is a circuit diagram of an electrophoretic display of the present invention.
Figure 2:
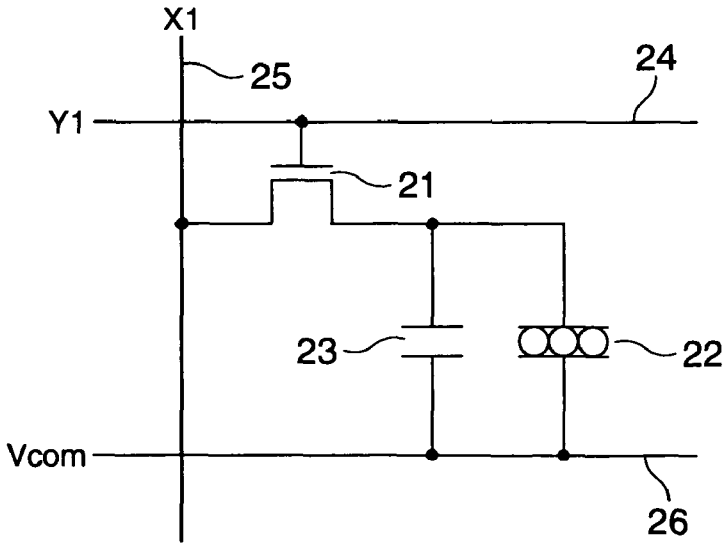
FIG. 2 shows a pixel of an electrophoretic display of the invention.

If an EPD includes a matrix in which M rows and N columns are arranged and a pixel electrode and switching element (a transistor ,for example) are provided at each of the cross points of rows and columns, this display is called as an active matrix electrophoretic display (AMPED, See FIG. 1.) The AMEPD is provided with M numbers of scanning lines (from Y1 to Ym) and N numbers of signal lines (from X1 to Xn) and these scanning lines and signal lines are orthogonally arranged each other. An electrophoretic element is disposed at each of the cross points of a scanning line 24 and a signal line 25, forming a pixel (See FIG. 2.) Each of pixels includes a switching transistor 21 and a pixel electrode. An electrophoretic material 22 is encapsulated between a pixel electrode and an opposite electrode 26. One of pixels arranged in a matrix is sequentially selected by a switching transistor and a predetermined image is introduced into each of pixel, forming a piece of an image. Thus, the invention shows a method of driving an electrophoretic display, which encapsulates an electrophoretic material between an active matrix substrate and an opposite substrate. The electrophoretic display device includes M×N numbers (M, and N are integers more than two) of pixels, which are arranged in a matrix. The M×N numbers of pixels includes M rows of scanning pixel groups having N numbers of pixels in each scanning line. Further, an image on the electrophoretic display can be displayed by making some of the M×N numbers of pixels switched at least from a bright (white) display to a dark (black) display, and vice versa. In this invention, a period for displaying a piece of an image on the electrophoretic display device is defined as a period for forming an image and a period for introducing an image signal to each of the M×N numbers of pixels with sequentially selecting each of the pixels is defined as a frame period. One pixel group includes N numbers of pixels and one pixel group is selected from M numbers of pixel groups if they are M pieces. An image signal is sequentially or concurrently introduced to N numbers of pixels during such selected period. This selected period is called as a horizontal scanning period. A period when all M numbers of scanned pixel groups are completely selected is a frame period and sometime called as a vertical scanning period since a scanning line is sequentially selected toward a vertical direction. In the EPD of the invention, a period for forming an image includes a plurality of frame or vertical scanning periods (L number is integers more than 2.)

As described above, the invention is applied to both a segment type or active type EPD. But, advantage of the invention become remarkable when numbers of pixels are more than several tens of thousands. Then, the following is explained as an active type EPD. If the invention is applied to not only a matrix type, but a segment type, scanning pixel groups are simply replaced with pixel groups.

Figure 3:
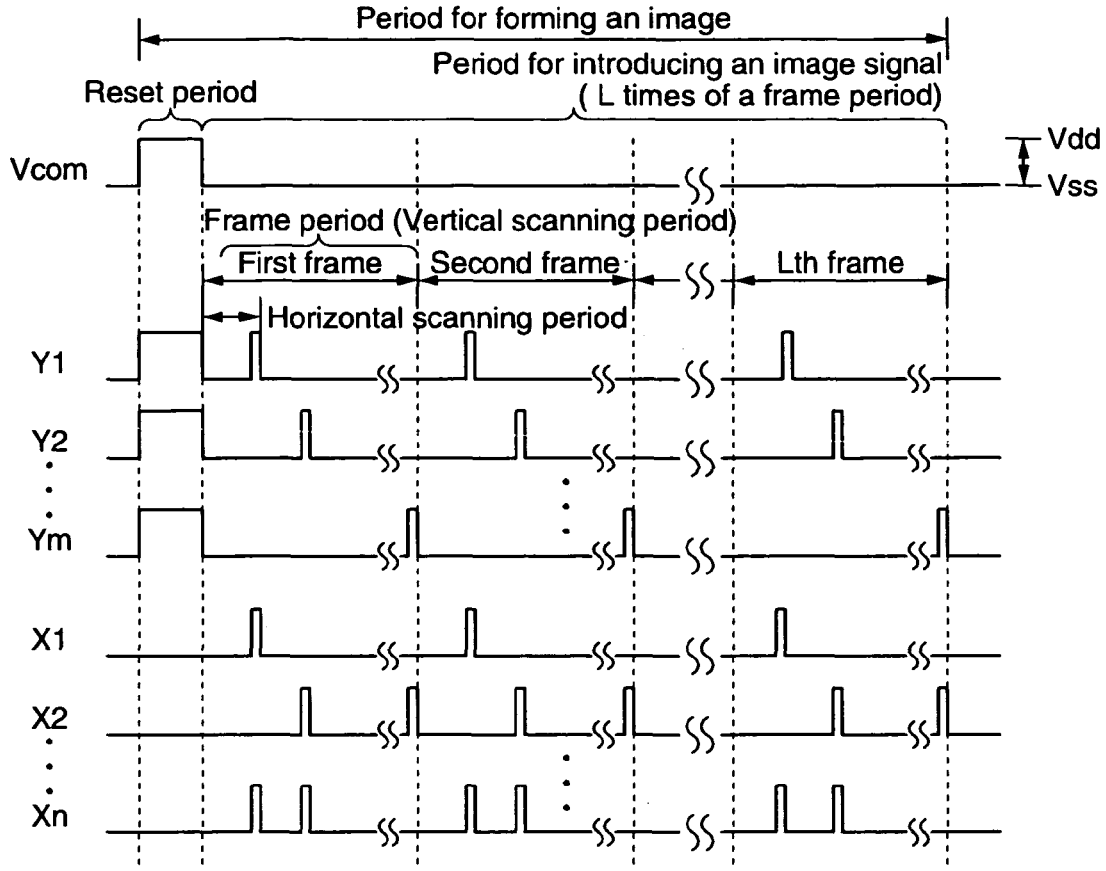
FIG. 3 shows a method of driving an electrophoretic display of the present invention.

A method of driving an EPD of the present invention is explained hereafter referring to FIG. 3. Here, the EPD has an active matrix structure explained in FIGS. 1 and 2. In the invention, a period for forming an image, which makes an EPD displaying one piece of an completed image, includes a period for introducing an image signal. The period for introducing an image signal includes L numbers (L is integers more than 2) of a frame period. Each of frames during a period for introducing an image signal is continuous, namely there is no time delay among frames adjacently placed each other. The total of periods for introducing an image signal comprising L numbers of frame periods are L times of a frame period. If there is continuous and no time delay among frames adjacently placed each other, it becomes easier to quickly read a clock signal and image signal, easily controlling an electrophoretic display. Further, a period for introducing an image signal becomes shortened to minimum time, realizing quick image switching. An image signal applying each of pixels during the period for forming an image is applied to the same pixel during all frame periods. An image signal is written to each pixel every one frame and the same image signal is written by L times during a period for introducing an image signal. During a horizontal scanning period, an image signal is concurrently applied to N numbers of pixels and a next image signal is transferred by a data line driving circuit during the period. This is called as a line sequential driving method. In this method, an image signal is written to each pixel during a horizontal scanning period, and an image signal is written to each pixel by L times of horizontal scanning periods during a period for forming an image.

As a different method of introducing image signal shown in FIG. 3, the data line drive circuit may transfer an image signal during the former part of the horizontal scanning period and select the scanning line after completing the transfer during the latter part of the horizontal scanning period. Then, an image signal may be concurrently written to N numbers of pixels connected to the selected scanning line. According to this method, an image signal is sent to N numbers of pixels after completing sending an image signal, certainly preventing from cross talk effect in which an image signal interferes with a next image signal.

In the present invention, when a period for selecting one of pixels groups is defined as a scanning period, a frame period is M times of a scanning period. Namely, in the invention, a frame period is M times of horizontal scanning periods. The reason is that the horizontal scanning period is defined as a period for selecting one of M numbers of scanning pixel groups when M rows and N columns are arranged in EPD (the sum of a period for completing the transfer of data from x1 to xn by the data line driving circuit with a period of selecting a specific scanning line by the data line driving circuit.) In the invention, a period for introducing an image signal is equal to or longer than response time of an electrophoretic material, which is described later. More specifically, the period for introducing an image signal is from one time to four times of the response time. Hence, introducing an image signal of which period is equal to or longer than specific time for switching an image with an electrophoretic material (response time) make it possible to realize the maximum contrast ratio and beautiful display. Further, if a period for introducing an image signal is shorter than the response time of an electrophoretic material (namely, a period for completing the introduction of L frames), a period for switching an image can not be shorter than response time since an electrophoretic material insufficiently responses. Therefore, the fast period for switching an image is the condition in which a period for forming an image signal is almost equal to the response time of an electrophoretic material (it is from one time to 1.2 times since there are 10% variation of the response time, one time and plus and/or minus 0.1 times.) A period for introducing an image signal is from one time to four times, and then a frame period is from one- Lth times to 4 -Lth times. As described later, if L is the range from 4 to 8, the excellent contrast ratio can be obtained (more specifically, if L is from 5 to 7, then further excellent contrast ratio is obtained.) The frame period becomes from one-8th times to one time of the response time of an electrophoretic material (it is from one- 7th times to four- 5th times when the contrast ratio is the most excellent.) In the invention, the same frame is superimposed by L times and the one time frame period is shorter than the response time of an electrophoretic material. In response to this, the period for horizontal scanning is from one-LMth times to four-LMth times (it is from one -6Mth times to four- 5Mth times when the contrast ratio is the most excellent.) Namely, in the invention, even if the numbers of pixels are increased and the numbers of scanning lines M are increased from several hundreds to several thousands, the frame period can be shortened since the horizontal scanning period can be shortened. If one piece of an image is formed by repeating a short frame period by L times, human eyes recognize that an entire image is uniformly changed. Conventionally, when scanning was performed from a upper line to a lower line, an image is sequentially changed from upper to lower, making eyes feel a pain. On the other hand, in the invention, an entire image is uniformly changed, switching an image like gradually emerging an image. The inventor investigated of which display methods between the conventional and the invention is comfortable among viewers and resulted in that almost viewers felt comfortableness in the method of switching an image in the invention. Namely, the invention is favorite in particular for switching an image in a display, which has a slow response speed. An image displayed by an EPD is comfortable for human eyes without feeling a pain if a frame period is shorter than 250 milliseconds. Further, viewers felt uncomfortable in switching an image if a period for forming an image is more than two seconds. Thus, it is preferable that a period for forming an image is less than two seconds.

Figure 4:
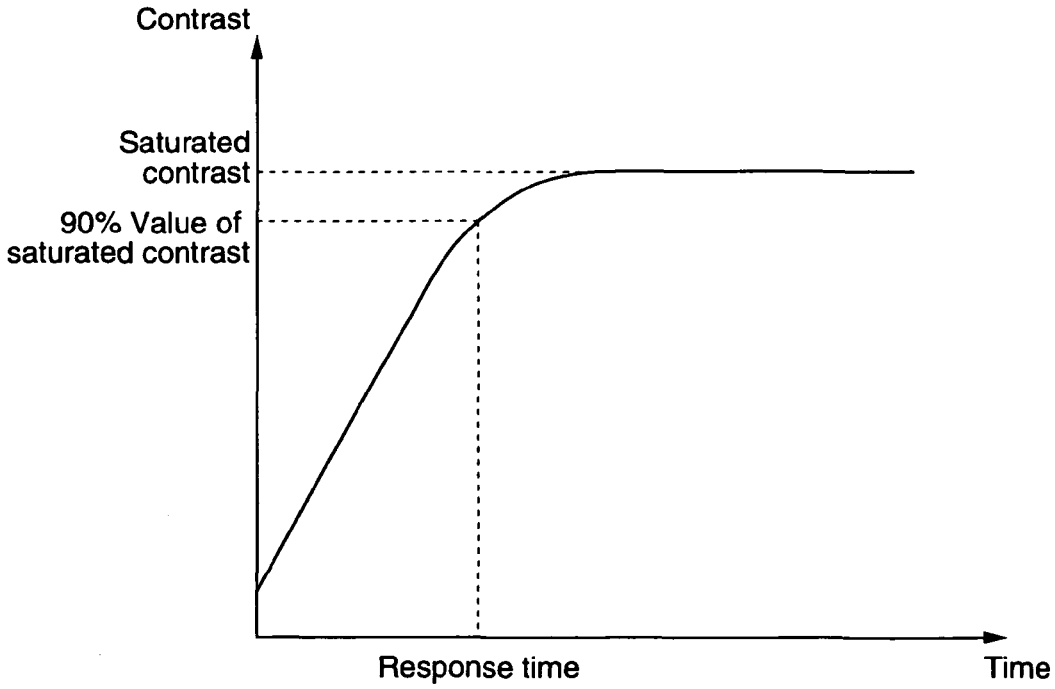
FIG. 4 shows a response time of an electrophoretic material.

Here, the response time of an electrophoretic material is explained. In an electrophoretic material, charged micro particles migrate between a pair of substrate, changing a spatial distribution of micro particles. The time of micro particles migration is the response time for an electrophoretic material. The response time is different among materials or applied voltages, but defined as 90% of the saturated contrast value (FIG. 4.) If continuing the apply of a predetermined voltage to an electrophoretic material, the contrast is saturated to be a constant value. Under the state, almost charged migrating particles are attracted to one of electrodes, no changing the spatial distribution of micro particles. This 90% of the saturated contrast value is the response time of an electrophoretic material.

In the invention, the period for forming an image may include a reset period, which introduces the same image signal to all the M×N numbers of pixels. In the invention, when a period for forming an image includes a reset period, the period for forming an image comprises a period for introducing an image signal, which is L times of a frame period, and a reset time. An image introduced during the reset time may be a signal for displaying brightness (white display) or darkness (black display) vise versa. For example, white micro particles with negative charges migrate during a black dispersion media. When viewing a display from the opposite electrode, positive voltage Vdd is applied to the opposite electrode as Vcom during the reset period. Further, negative voltage Vss is applied to all pixels on the matrix substrate. Then, white micro particles are attracted to the opposite electrode, forming white display during the reset period. A favorite image without including residual image is obtained if the reset time is longer than the response time of an electrophoretic material. In the invention, the reset period is longer than the response time of an electrophoretic material. Then, an entire image is completely erased during reset period and a next clear image can be displayed without residual image. If the reset period is too longer, human eyes feel uncomfortable when an image is changed. In order to avoid it, the reset period is preferably one time to two times of the response time, under one second at most. The response time of an electrophoretic material is from 10 milliseconds to 500 milliseconds. So the reset period must be set within the range in which human eyes do not feel uncomfortable. According to this structure, an entire image is reset with white (or black) during short time at the time when an image is changed, then an entire image is uniformly emerged. This display make a viewer feel comfortable, and is appropriate for an electronic paper. Either white resetting or black resetting is available, but resetting it, which is the same color of the background, is a more comfortable view. For example, if a background is white and letters are black in a paper or a book, white resetting is performed. This can avoid flickering and letters are uniformly emerged, preventing human eyes from a pain even when reading an electronic paper which comprises an electrophoretic display for longer time.

EXAMPLE

Figure 5:
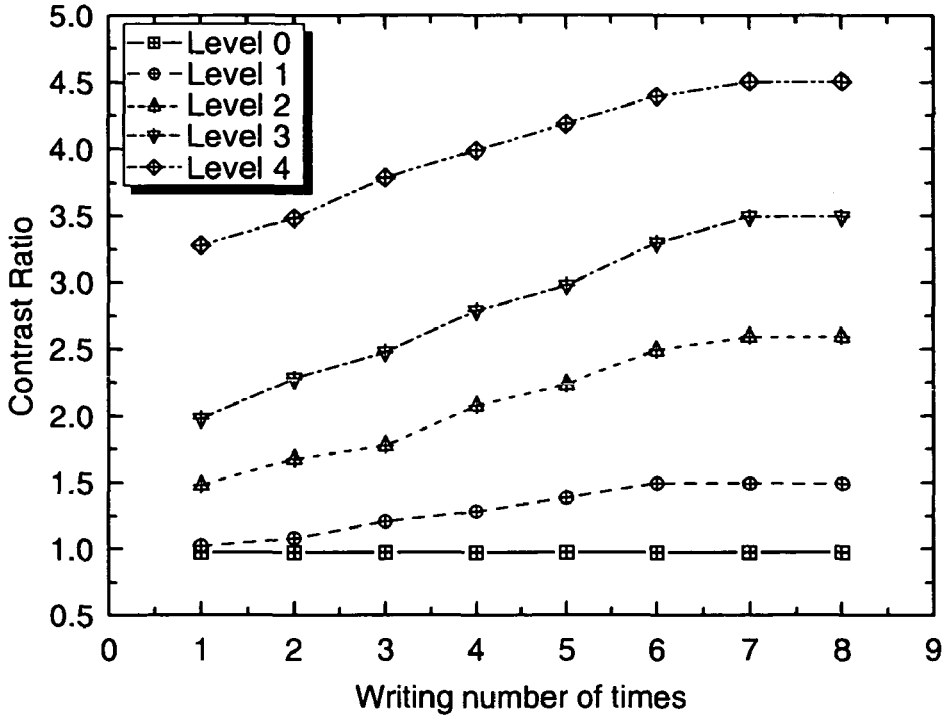
FIG. 5 shows a dependency of a contrast ratio on frame numbers.
Figure 6:
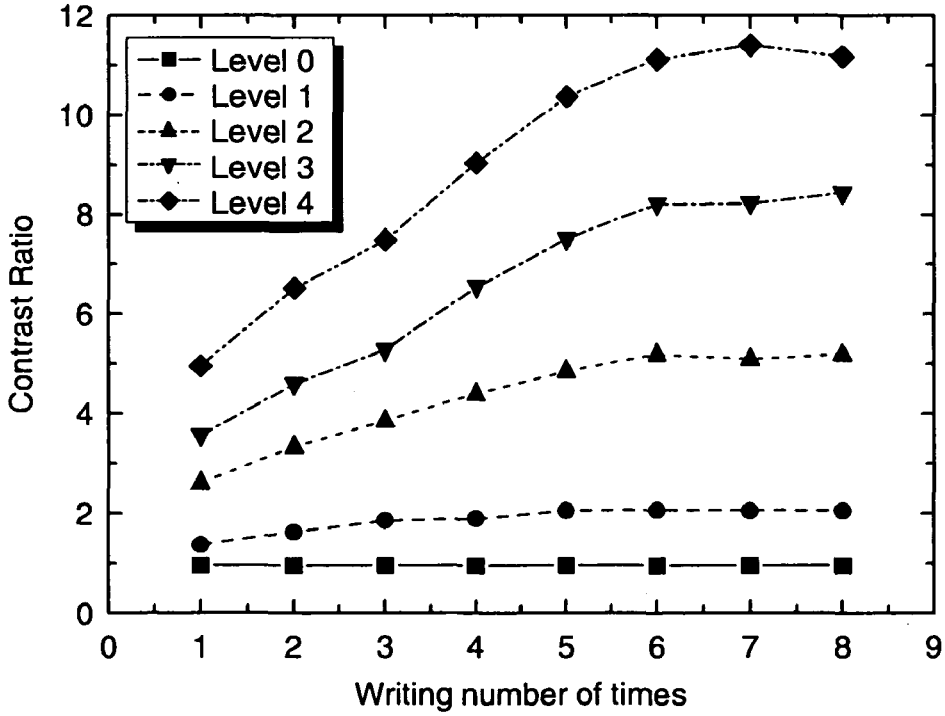
FIG. 6 shows a dependency of a contrast ratio on frame numbers.
Figure 7:
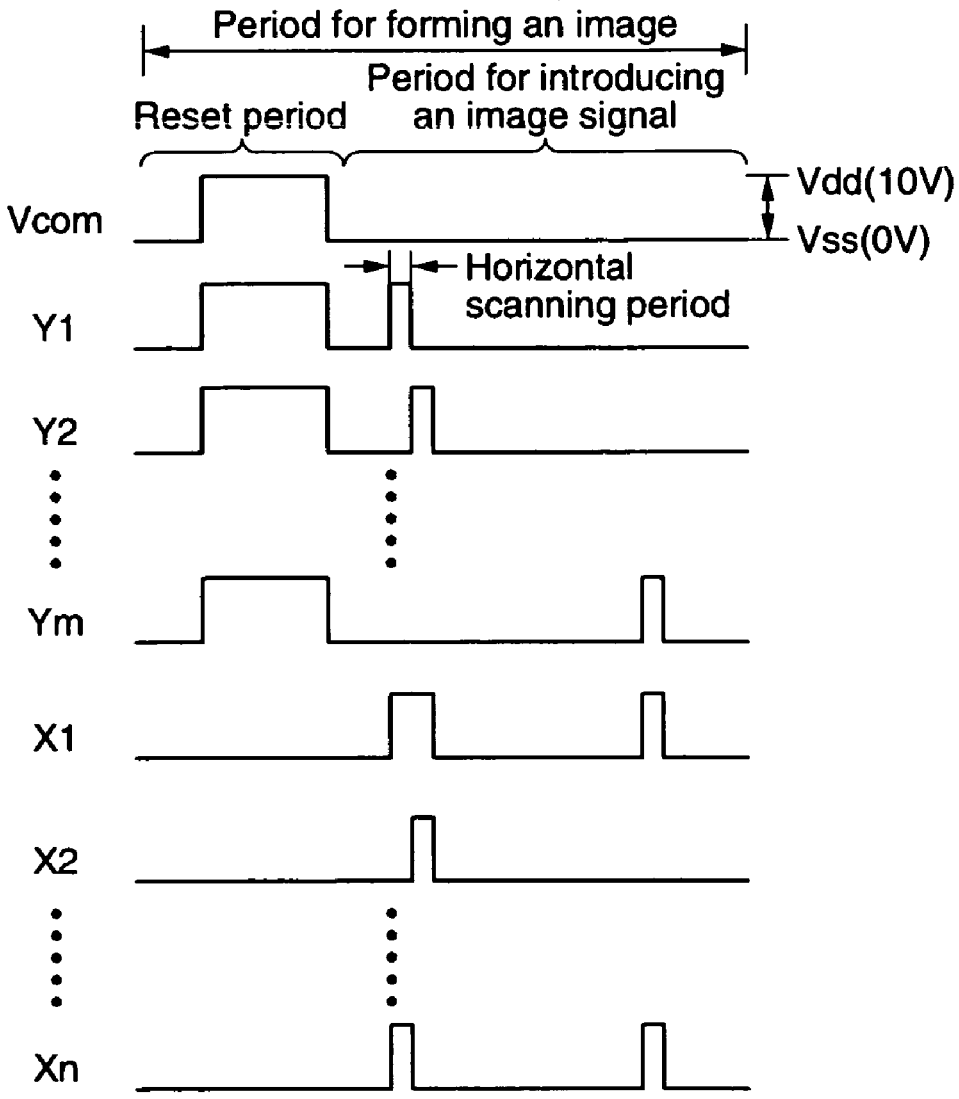
FIG. 7 shows a method of driving an electrophoretic display of the conventional technology.

An AMPED comprising 240 rows and 320 columns was manufactured by using a low temperature thin film semiconductor process. An area-gray scale method in which five gray scales are attained by unifying four elements is adapted. Then, the numbers of elements of a display is 120×160. In the driving method shown in FIG. 3, a period for writing an image to a pixel is 10 microseconds, the horizontal scanning period is 1 millisecond and the frame period is 240 milliseconds. The response time of an electrophoretic material is 400 milliseconds and the reset period is 600 milliseconds. Based on these conditions, it was checked that the change of number L of frames affected the change of a contrast ratio (shown in FIGS. 5 and 6.) In FIG. 5, an electrophoretic material of single particle system is used. In this material, white charged micro particles are dispersed in a blue dispersion media. Further, in FIG. 6, an electrophoretic material of dual particles system is used. In this material, white negative-charged micro particles and black positive-charged micro particles are dispersed in a transparent dispersion media. In FIGS. 5 and 6, the vertical axis shows a contrast ratio. This ratio is the ratio of the reflectance directly after white resetting to the reflectance directly after completing a period for forming an image (the reflectance directly after white resetting/the reflectance directly after completing a period for forming an image.) The level 10 means that a white image signal is applied to all four elements after white resetting. The level 11 means that a blue image signal (FIG. 5) or a black image signal (FIG. 6) is applied to one of four elements after white resetting. The level 12 means that a blue image signal (FIG. 5) or a black image signal (FIG. 6) is applied to two of four elements after white resetting. The level 13 means that a blue image signal (FIG. 5) or a black image signal (FIG. 6) is applied to three of four elements after white resetting. The level 14 means that a blue image signal (FIG. 5) or a black image signal (FIG. 6) is applied to all four elements after white resetting. In FIGS. 5 and 6, the horizontal axis shows frame numbers L during a period for forming an image. As shown in these figures, the contrast ratio is excellent during numbers of frames L 4 to 8 irrelevant to one particle or two particles system (but over 4 in the one particle system (FIG. 5) and over 9 in the two particle system ((FIG. 6)). In particular, this is further excellent from numbers L 5 to 7 and the best is L=6. If the numbers L is more than 8, the contrast is saturated. Namely it is confirmed that there is no further effect even increasing the numbers more than 8. It is also confirmed that, if one image during a frame for short time is superimposed by 5 times to 7 times, changing an image is smooth and seems to be comfortable and the contrast ration is high. An electrophoretic material has a tendency of holding the state of stopping when micro particles stop at once. Therefore, in order to easily move micro particles, it is better to move them after moving them a little, instead of suddenly moving them from the stopped state. Namely, a method for forming an image in which a short frame is repeated by L times improves the contrast ratio.

According to the invention, it is possible to change an image with making human eyes feel comfortable even in the slow response time of a electrophoretic material. Further, the high contrast ratio is easily obtained. Therefore, when the invention is applied to an electronic paper such as an electronic book or an electronic paper, a tiredness of human eyes can be sharply reduced even after reading many pages for longtime.

The entire disclosure of Japanese Patent Application Nos. 2005-052622, filed Feb. 28, 2005 and 2005-117872, filed Apr. 15, 2005 are expressly incorporated by reference herein.

What is claimed is:

1. A method of driving an electrophoretic display which encapsulates an electrophoretic material between a pair of substrates, the electrophoretic display including M×N pixels (M and N being integers greater than two), the M×N pixels including M scanning pixel groups each having N pixels, the method comprising:

displaying an image on the electrophoretic display by switching some of the M×N pixels at least from a bright display to a desired dark display, and vice versa, wherein a period for forming an image includes a plurality of L frame periods (L being an integer greater than two), each of the frame periods being a period for introducing image signals to the M×N pixels by sequentially selecting each of the M scanning pixels groups, wherein image signals are applied to at least one of the M×N pixels a plurality of times during the period for forming the image, wherein the L frame periods include a first frame period and a second frame period successively following the first frame period, and wherein the image signals are applied to the same pixels in each of the first frame period and the second frame period, and wherein the image signals provided in each of the first and second frame periods are equal to each other in width and electric potential.

2. The method of driving an electrophoretic display according to claim 1, wherein a period for selecting one of the scanning pixel groups is defined as a horizontal scanning period, and wherein each of the frame periods is M times the horizontal scanning period.

3. The method of driving an electrophoretic display according to claim 1, wherein the displaying of the image on the electrophoretic display by switching some of the M×N pixels at least from a bright display to a desired dark display, and vice versa, includes:

sequentially selecting, in a first of the L frame periods, each pixel group of the pixel groups in the some of the M×N pixels and introducing a respective image signal to each of the selected pixels; and sequentially selecting, in a second of the L frame periods, each pixel group of the pixel groups in the some of the M×N pixels and introducing the respective image signal to each of the selected pixels.

4. A method of driving an electrophoretic display device including a plurality of scanning lines, at least one signal line that crosses the plurality of the scanning lines, and a pixel that corresponds to an intersection between one of the plurality of the scanning lines and the signal line, the pixel including a plurality of electrically charged micro-particles dispersed in dispersion media, the method comprising:

forming a complete display image in an image forming period, the image forming period including L frame periods (L being an integer greater than two), wherein each of the plurality of scanning lines are selected in each of the L frame periods, wherein the L frame periods include a first frame period and a second frame period successively following the first frame period; and providing the pixel with an image signal in each of the first and second frame periods when the scanning line corresponding to the pixel is selected.

wherein the image signal provided in the first frame period and the image signal provided in the second frame period are equal to each other in width and electric potential.

5. The method of driving a display device according to claim 4, wherein the total of the L number of frame periods is a period that is L times one of the frame periods.

6. The method of driving a display device according to claim 4, the display device further comprising a second pixel that corresponds to intersection between another of the plurality of scanning line and the signal line, wherein the image forming period further includes a reset period in which a certain image signal, for either generating a bright or dark display, is provided to the one pixel and the second pixel.

7. The method of driving a display device according to claim 6, wherein the image forming period includes a period, which is L times one of the frame periods and includes the reset period.

8. The method of driving a display device according to claim 6, wherein the reset period is longer than a response time of the plurality of electrically charged micro-particles.

9. The method of driving a display device according to claim 4, wherein the frame period is shorter than 250 milliseconds.

10. The method of driving a display device according to claim 4, wherein the image forming period is longer than a response time of the plurality of electrically charged micro-particles.

11. The method of driving a display device according to claim 4, wherein the image forming period includes five or more frame periods.

12. The method of driving a display device according to claim 4, wherein the image forming period is under two seconds.

13. The method of driving a display device according to claim 4, wherein each of the L number of frame periods has a same length.

14. The method of driving a display device according to claim 4, wherein the pixel displays an image between the brightness image and the darkness image including a gray scale image.

15. A method of driving an electrophoretic display having a plurality of electrically charged micro-particles arranged in a matrix of pixels, each of the pixels corresponding to an intersection between a scanning line and a signal line, the method comprising:

a.) scanning, in a first frame period, each of the scanning lines once and applying an image signal to at least one of the pixels over one of the signal lines connected to the pixel such that the electrically charged micro-particles in the pixel move; and b.) substantially immediately thereafter, scanning, in a second frame period, each of the scanning lines at least once again and applying the same image signal to the same pixel over the same signal line to further move the electrically charged micro-particles in the same pixel for forming a desired image;

wherein the micro-particles have a response time, wherein a period required for completely forming the desired image is one to four times the response time, wherein the frame periods in steps a.) and b.) each are one-fourth to one-eight of the period required for completely forming the desired image; and wherein the image signals provided in each of the first and second frame periods are equal to each other in their width and electric potential.

16. The method of claim 15, wherein the frame periods in steps a.) and b.) each are less than 250 milliseconds.

17. The method of claim 16 wherein a new image is formed by erasing an existing image in a reset period of less than one second and steps a.) and b.) are repeated with a new set of image signals.

18. The method of claim 17 wherein:

in the reset period, the same image signals are applied to all of the pixels to drive the matrix of pixels to an all-white display or an all-black display.

19. The method of claim 18, wherein the reset period is longer than the response time of the micro-particles.

* * * * *